United States Patent [19]

Burton

[11] Patent Number: 4,785,606

[45] Date of Patent: Nov. 22, 1988

[54] MECHANIZED ROOF LAYING SYSTEM

[75] Inventor: Rodney P. Burton, Reynoldsburg, Ohio

[73] Assignees: James E. Johnson; Rod Cropper, both of Bolivar, Ohio; William J. Sharp, Fayette, Mo. ; part interest to each

[21] Appl. No.: 93,562

[22] Filed: Sep. 4, 1987

[51] Int. Cl.[4] ..... E04D 15/00

[52] U.S. Cl. ..... 52/749; 33/648; 182/45

[58] Field of Search ..... 52/749, 747; 33/648; 182/45

[56] References Cited

U.S. PATENT DOCUMENTS

| | | | |
|---|---|---|---|
| 74,472 | 2/1868 | Wood . | |
| 77,308 | 4/1868 | Mudge . | |
| 443,467 | 12/1890 | Templin . | |
| 463,106 | 11/1891 | Dees . | |
| 543,498 | 7/1895 | Monbeck . | |
| 641,109 | 1/1900 | Hinds . | |
| 710,281 | 9/1902 | Leek . | |
| 788,710 | 4/1905 | Anderson . | |
| 852,141 | 4/1907 | Sebree | 182/45 X |
| 988,808 | 4/1911 | Parris . | |
| 1,016,935 | 2/1912 | Clark . | |
| 1,380,485 | 6/1921 | Langeberg | 33/649 |
| 1,412,060 | 4/1922 | Mattson . | |
| 1,433,772 | 10/1922 | Barclay . | |
| 1,549,671 | 8/1925 | Kridler et al. . | |
| 1,732,973 | 10/1929 | Krumholz . | |
| 1,775,815 | 9/1930 | Dome . | |
| 1,890,928 | 12/1932 | Black . | |
| 1,954,213 | 4/1934 | Leonard . | |
| 2,006,443 | 7/1935 | Craven . | |
| 2,157,663 | 5/1939 | Giebink . | |
| 2,426,825 | 9/1947 | Geary . | |
| 2,470,183 | 5/1949 | Peters . | |
| 2,715,780 | 8/1955 | Hageman . | |
| 2,716,288 | 8/1955 | Geddis et al. . | |
| 2,814,533 | 11/1957 | Van Horn . | |
| 2,816,367 | 12/1957 | Fink et al. . | |
| 2,840,424 | 6/1958 | Broderick . | |
| 2,889,632 | 6/1959 | Longhi . | |
| 2,891,318 | 6/1959 | Harrison et al. . | |
| 3,272,267 | 9/1966 | Langas . | |
| 3,842,934 | 10/1974 | Bartlett . | |
| 4,056,889 | 11/1977 | Barnett, III . | |
| 4,068,446 | 1/1978 | Brueske . | |
| 4,110,911 | 9/1978 | Sucheck . | |
| 4,183,144 | 1/1980 | Barnett, III . | |
| 4,285,134 | 8/1981 | Schmanski . | |
| 4,541,217 | 9/1985 | Stewart . | |

*Primary Examiner*—Carl D. Friedman
*Attorney, Agent, or Firm*—Daniel J. Hudak

[57] ABSTRACT

A mechanized roof shingle laying system has a plurality of lateral supports which are attached to a roof. Desirably, a plurality of horizontal track sections span the entire roof and engage alignment tabs on the lateral supports. A carriage, ridden by an operator, is movable along the horizontal track sections. Shingles carried by the carriage are laid on the roof along a lip guide of the horizontal track sections and produce an accurate alignment of the shingles. When a row of shingles has been laid in alignment upon the roof and fastened thereto, the horizontal track supports are moved to an adjacently spaced alignment tab of the lateral supports so that another row of shingles can be positioned on the roof. The system provides a high production rate with consistently good accurate alignment of the shingles.

10 Claims, 3 Drawing Sheets

MECHANIZED ROOF LAYING SYSTEM

TECHNICAL FIELD

The present invention relates to a system for mechanizing the laying of roof shingles. More specifically, the present invention relates to the utilization of lateral alignment supports, to a horizontal track and to a carriage slidably engaging the horizontal track such that roof shingles are systematically laid in an accurate and in an efficient manner.

BACKGROUND OF THE INVENTION

Heretofore, numerous shingle guide or alignment devices have been utilized in the accurate laying of shingles upon a roof. Examples of such various apparatuses include the following:

U.S. Pat. No. 710,281 to Leek relates to a shingling carriage and gauge device having a rail, a carriage mounted thereon, an arm adjustably secured to the carriage, a supporting bracket adjustably secured to the arm and carrying a shingle bracket, and the gauge.

U.S Pat. No. 3,842,934 to Bartlett relates to an apparatus containing a plurality of elongated load supporting members adapted to be supported in a spaced-apart relationship to a sloping roof, a hook means attached to the elongated load supporting members being adapted to extend over the gable of the sloping roof and contact the opposite sloping roof, a load supporting carriage riding on each of the elongated load supporting members and containing a means to incrementally advance the load supporting carriages on the elongated load supporting members and an additional elongated load supporting member having one portion of the member residing on one load supporting carriage and another portion of the load supporting member residing on another load supporting carriage.

U.S. Pat. No. 4,056,889 to Barnett relates to fixtures for lining asphalt composition strip shingles wherein an elongated alignment guide is provided for supporting the lower edges of a plurality of shingles to be laid on a roof. The alignment guide can contain a plurality of sections of a specific length thereby permitting the assembly of any type of standard shingle length. A clamping device is attached to the alignment guide and has a pair of essentially flat, opposed jaws for compressing the jaws together to grip a shingle in the previous laid row.

U.S. Pat. No. 4,110,911 to Sucheck relates to a single gauge for aligning a second row of shingles to a first, lower row of shingles fixed to a roof.

U.S. Pat. No. 4,183,144 to Barnett relates to a device which is similar to that described hereinabove with regard to Barnett U.S. Pat. No. 4,056,889.

U.S. Pat. No. 4,285,134 to Schmanski relates to a shingle locating gauge for use in aligning and applying roofing shingles which has a pair of generally parallel side supports attached to an elongated alignment guide. A load spreading bar and an elongated support member extend generally parallel to the alignment guide and are each connected to side supports. Mounted on the support member are a pair of alignment stops and a clamp adapted to apply force against the load spreading bar.

U.S. Pat. No. 4,541,217 to Stewart relates to a double roll shingle alignment fixture for aligning rows of roofing shingles. A first longitudinal panel has a grooved lower flange with a lower edge and a plurality of grooves adapted to be aligned with a first row of shingles. A second longitudinal panel is hingedly mounted to the first longitudinal panel along a longitudinal axis to be folded down on top of the second row of shingles after being fastened to the roof.

None of the above devices relates to a system for mechanizing the laying of shingles having at least a pair of lateral supports attached to a roof, a horizontal track engaging alignment tabs of the lateral supports, a carriage for carrying shingles along the length of the horizontal track, and the like.

SUMMARY OF THE INVENTION

It is therefore an aspect of the present invention to provide a system for the efficient and accurate installation of shingles.

It is a further aspect of the present invention to provide a system for the efficient and accurate installation of shingles, as above, wherein a carriage carrying shingles thereon engages a horizontal track which, in turn, is located between lateral supports attached to a roof.

It is a still further aspect of the present invention to provide a horizontal track which can be utilized in the installation of shingles, wherein said horizontal track contains structural features such as a frame, a platform section, means for adjusting the distance between one end of said platform and said frame, an alignment lip for laying shingles in place and an alignment stop.

It is yet a further aspect of the present invention to provide a carriage which can be utilized in association with a system for the installation of shingles, wherein the carriage contains an operator section, a section for carrying shingles and a flange portion for slidably engaging a rail of the horizontal track.

These and other aspect of the present invention will become apparent from the following detailed specification.

In general, a system for applying shingles to a roof comprises, at least a pair of lateral supports attachable to the roof, said lateral supports having a plurality of alignment tabs extending therefrom, at least one horizontal track section, said horizontal track section engaging said alignment tabs, said track section having a front alignment lip guide, and a shingle carriage, said shingle carriage slidably engaging said track section so that shingles can be laid in alignment on the roof against said alignment lip guide.

DETAILED DESCRIPTION OF THE INVENTION

Figure 1:
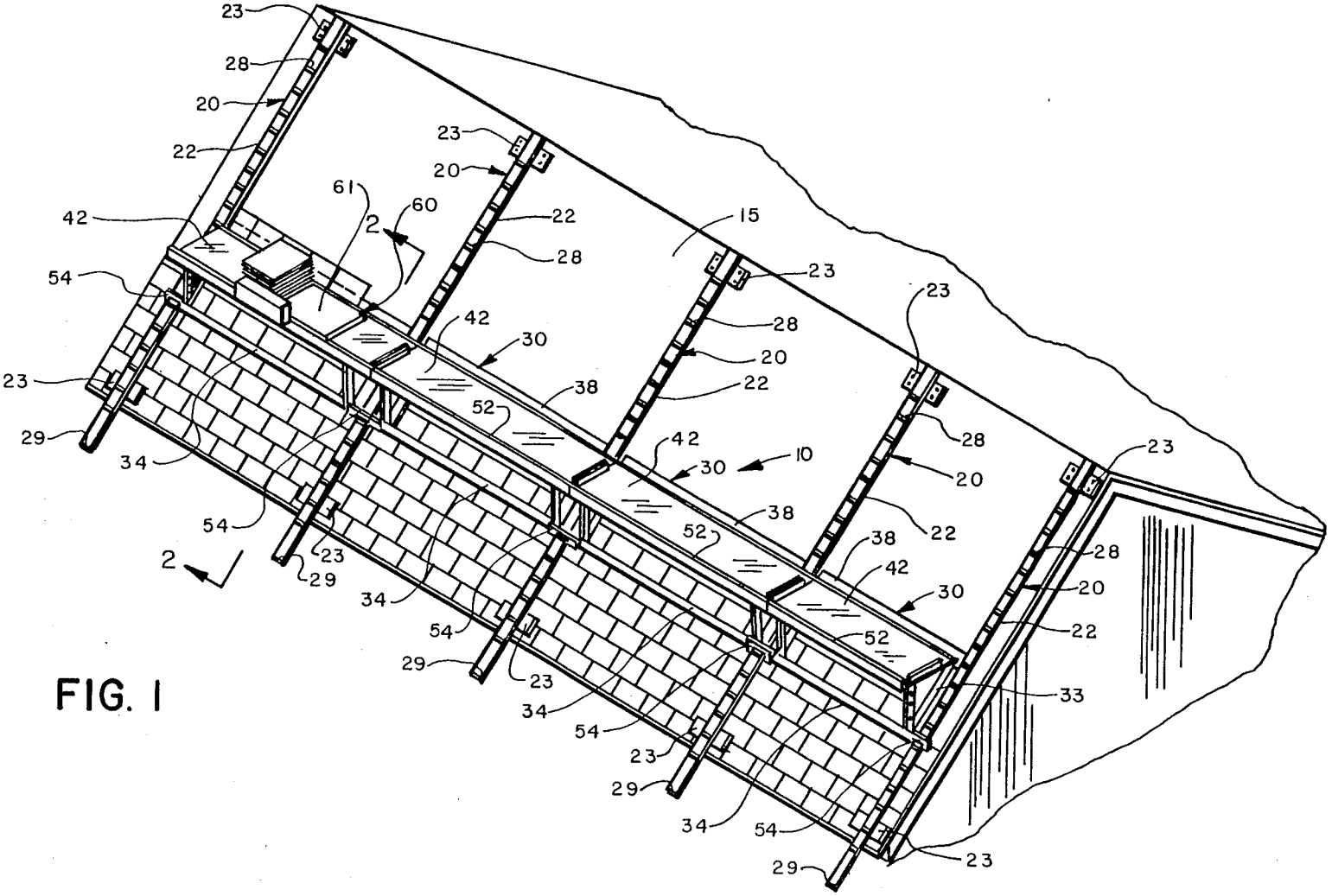
FIG. 1 is a perspective view of the overall system showing the various components thereof.
Figure 2:
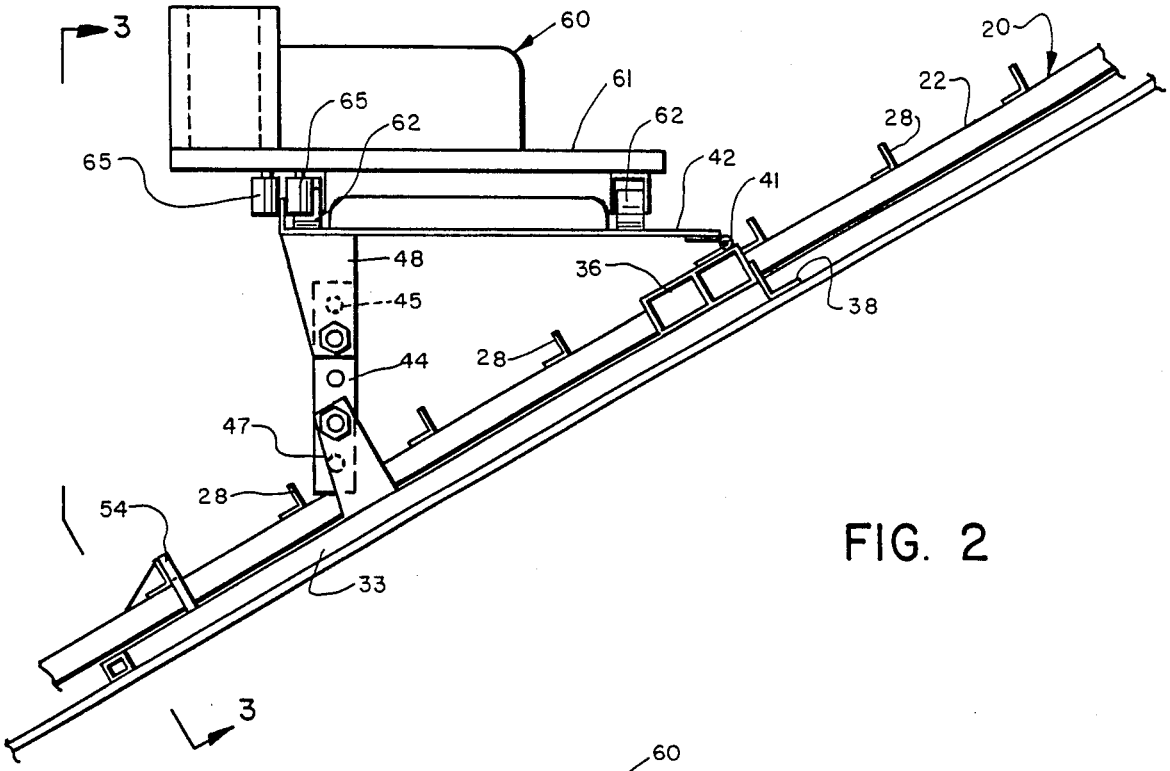
FIG. 2 is a side elevational view of a lateral support, a track section of a carriage.
Figure 3:
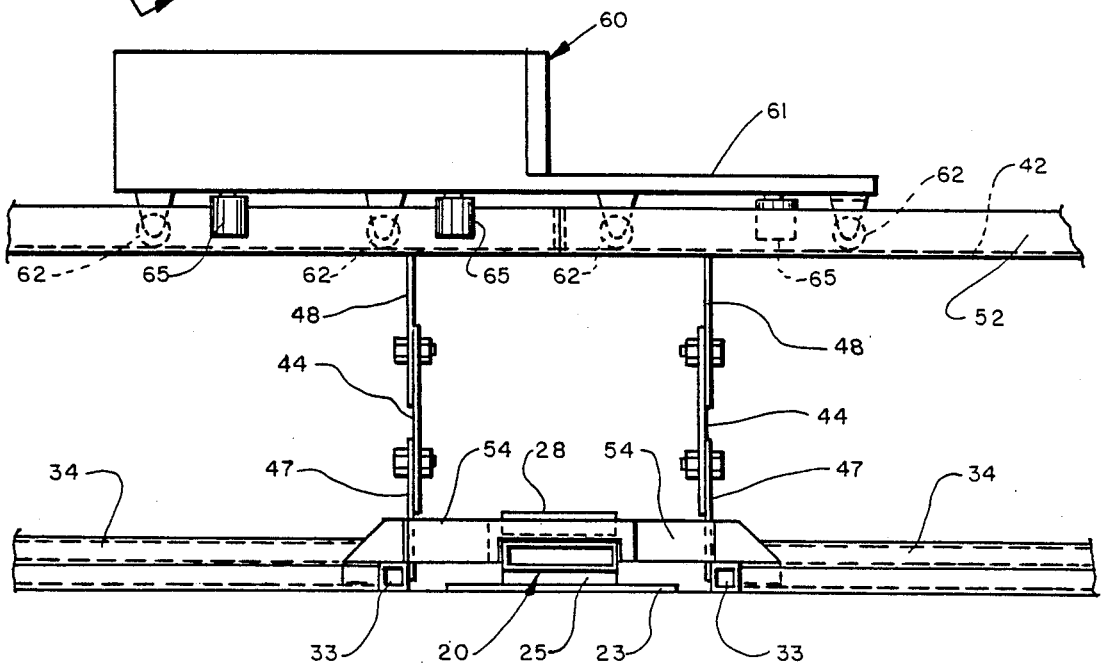
FIG. 3 is an end elevational view of the horizontal platform track.
Figure 4:
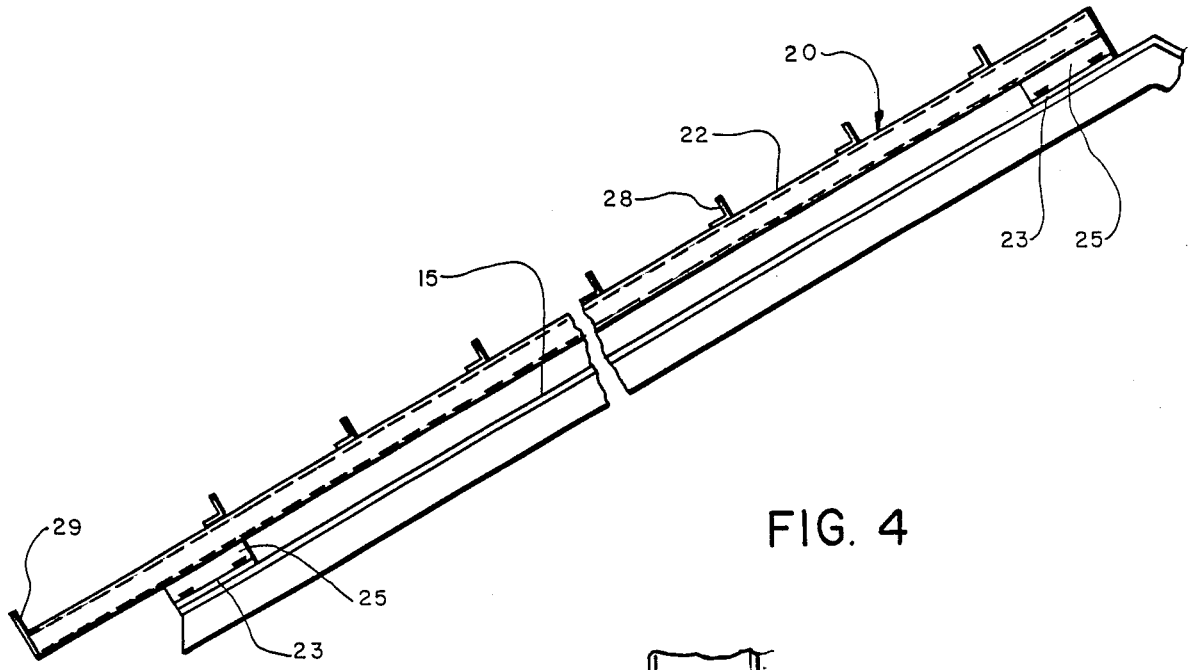
FIG. 4 is a side elevational view of the horizontal platform track.

According to the concepts of the present invention, a mechanized shingle laying system is provided. An embodiment of the system is shown in FIG. 1 and is generally indicated by the numeral 10. The system is typically applicable to any roof or other substrate to which shingles or other covering material are generally applied in an abutting and/or overlapping manner. Although the invention hereinafter will be discussed with regard to shingles, it is to be understood that other suitable covering material, roofing material, etc., can be utilized.

As best seen in FIG. 1, lateral supports 20 are shown as located on roof 15 such as the roof of a home. The supports can be made out of any suitable material such as metal and desirably a material which is not adversely affected by weather such as aluminum. At least a pair of lateral supports exist although a plurality thereof, that is more than one pair, can be utilized such that they generally extend across or span the entire roof. The distance between the lateral supports is determined by the width of horizontal track sections which track sections are generally indicated by the numeral 30. The length of lateral supports 20 can be any desirable length and generally is such that it extends from the top or peak of roof 15 to an overhanging position of from about 1 to about 5 feet beyond the bottom roof edge. Should the roof be of an extremely long length from peak to bottom, a plurality of the lateral supports can be attached together. The lateral supports contain a base member 22 which generally extends along the length thereof. To one end of the base member is connected an attachment plate 23 having apertures (not shown) therein. Through any suitable fastening mechanism such as nails, the attachment plate and hence the lateral support is connected to the peak of the roof or to the peak vicinity of the roof. Connection block 25 connects the top portion of the lateral support to the attachment plate in any conventional manner as through a welding seam. Lateral support base member 22 contains a plurality of spacer blocks 27 usually one at the top end and one at the bottom end on the underside thereof. The connection block can also serve as a spacer block as it does in the embodiment shown. The depth of the spacer blocks can be of any desirable height such that shingles can readily be placed under the base member. A suitable height utilized in connection with applying shingles to a home is approximately 1¼". Naturally, larger or smaller heights can be utilized. To the topside of base member 22 is attached a plurality of alignment tabs 28 in any conventional manner as through a welding seam. Alignment tabs 28 are precisely located with regard to one another and correspond to a desired distance between rows of successive shingles applied to the roof. Considering a typical house roof, the distance between successive shingles is usually 5" and hence the alignment tabs can be located 5" apart from the same corresponding portion of an adjacent tab. Tabs 28 generally extend along the entire length of base member 22. In order to assure accurate alignment of tabs 28 on the roof, each alignment plate 23 of every support member is attached to the roof at exactly the same distance from the roof peak. A safety stop tab 29 generally exists at the bottom or end portion of lateral support base member 22 and has a much greater height than alignment tabs 28. The purpose of safety stop 29 is to insure engagement thereof with horizontal track 80 should the same ever be accidentally disconnected from alignment tabs 28 and slide down the lateral support.

The shingle roof laying system 10 contains as many horizontal track sections 30 as is necessary to extend across or span the width of the roof. The horizontal tracks can be of any desired width and consists of so called whole or full sized sections along with fractional sections. For example, the horizontal track sections can be 19' in width or longitude along with fractional sections such as 9', 6', and 3'. Track sections 30 can be made of any suitable material such as metal with aluminum being preferred. The horizontal track is made of various members which are connected together in any suitable manner as through fasteners but preferably is welded or riveted together.

The frame of the horizontal platform track has legs 33 which extend along the length of the roof. Cross member 34 connects the legs together. Cross channel 36 desirably extends across the width of the front or leading edge of the horizontal track and is connected to the top surface of legs 33. The leading edge is defined as the edge which is closest to the roof peak. To cross channel 36, desirably along the entire length thereof, is attached or connected front alignment lip 38. The lip can be an angle iron which extends outward an inch or two. Care is taken in positioning and connecting cross channel 36 to frame legs 33 such that the channel extends perpendicular to lateral supports 20 when horizontal track section 30 is placed thereon. Hence, alignment lip 38 is also perpendicular to the lateral supports and ensures that a true and accurate alignment of the shingles placed thereupon is achieved.

Also connected to cross channel 36 is hinge 41 which is fastened to the leading edge of platform 42. The hinge can be a plurality of hinges or desirably a full length strap hinge. The length of platform 42 is such that it readily accommodates a carriage, generally indicated by the numeral 60, thereon. Platform 42, which is pivotally attached to the cross channel and is juxtaposition to the alignment lip, is desirably located in a level position with regard to the earth. That is, it does not slant but desirably is parallel to the earth's surface or to the floors of the building. A level position is achieved by the use of spacer bars 44 which can have a plurality of alignment apertures 45 therein or through the use of different size spacer bars. An appropriate spacer bar or aperture thereof is removably connected to a lower bracket 47 with the remaining end of the spacer bar or apertures on the remaining end removably connected to an upper bracket 48. Lower bracket 47 is attached or connected to frame legs 33 whereas upper bracket 48 is fastened or connected to platform 42. Bolts and nuts are generally utilized to fasten the spacer bar to the upper and lower brackets. Thus, regardless of the pitch of roof 15, platform 42 can be made to reside in a level position.

Rail 52 is attached generally along the entire width or longitude of the platform. Generally, the rail is located at the back portion of the platform. Rail 52 serves as a guide for carriage 60 to travel along the entire longitude of the platform. Stop brackets 54 are connected to the horizontal track section so as to engage alignment tabs 28 of the lateral supports. A suitable location of stop brackets 54 is at the lateral ends of cross member 34. Thus, when horizontal track section 30 is placed between a pair of lateral supports 20, the back edge of stop bracket 54 will engage the front surface of alignment tab 28. Naturally, stop brackets 54 are carefully positioned and attached to the cross channel such that an accurate alignment of front alignment lip 38 is achieved. As a safety precaution, safety stop bracket 58 is attached to the frame and extends laterally therefrom. Should stop brackets 54 become disengaged from alignment tabs 28, they will engage lateral support safety stop 29 and thus prevent the horizontal platform track from falling off the lateral supports.

As part of the rapid but yet accurate shingle installation system is the provision of a carriage, generally indicated by the numeral 60, which movably engages horizontal platform 42. Carriage 60 is not a scaffolding device or a portable work stage but rather a cart for carrying shingles as well as to provide a seat for the operator thereof. The carriage has no provision for altering its pitch with regard to the roof since any such adjustment is accomplished by pivoting the horizontal track and maintaining a desired horizontal position (i.e. parallel to the earth's surface) through the use of spacer bars 44. Carriage 60 has a floor portion 61. A plurality of wheels 62 are attached to the underside of the floor portion. In order to provide a smooth transmission of the carriage along a plurality of track sections 30, the bottom wheels are generally longitudinally staggered. That is, the wheels are not in exact alignment with one another so that when the carriage is transferred from one platform 42 to an adjacent platform 42, the wheels do not become lodged or seated within the small crack or recess which exists between the adjacent platforms. Any number of wheels can be utilized. In the embodiment shown, eight wheels are utilized on the bottom portion of the carriage. The bottom portion of the carriage floor also contains a plurality of rail wheels 65. Wheels 65 slidably engage horizontal and longitudinal track rail 52. Accordingly, carriage 60 moves in a straight line along the plurality of connected longitudinal platforms 42.

Figure 5:
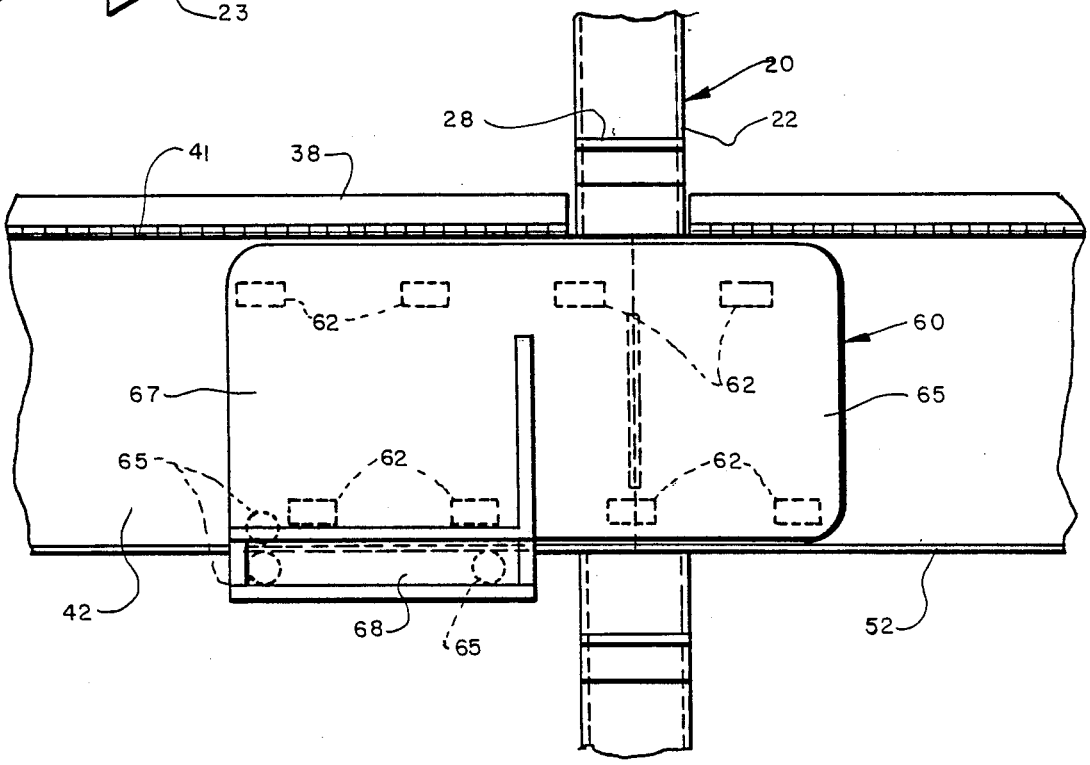
FIG. 5 is a bottom elevational view of the carriage.

As best seen in FIG. 5, carriage 60 contains a seat portion 65 whereupon an operator can be seated. Although a small chair may be provided, it has been found that an operator can be comfortably seated on the carriage in close proximity to shingle carrying portion 67. During operation of the carriage, an operator merely unloads a single shingle from carriage shingle portion 67 onto the roof of the building and abuts the shingle against the preceding laid shingle as well as against horizontal track alignment lip 38. Inasmuch as the operator is seated at a low elevation, very little backbending is required to apply the shingles and hence operator backache is generally reduced if not completely eliminated. The operator can quickly move carriage 60 longitudinally across the entire roof with his legs. As shown in FIG. 5, the top portion of carriage floor 61 can have a tool caddy 68 thereon so that various tools required in utilizing the system can be carried with the operator. An umbrella (not shown) can also be mounted to the carriage to provide a shaded area for the operator.

The roof shingle system 10 is designed to be utilized in connection with power fasteners, i.e. staples, nails, etc. Any conventional power fastener can thus be utilized and desirably has an extended handle thereon so that an operator can walk along the roof and without bending apply fasteners thereto. Additionally, the power fastener can have a guide thereon for aligning the fastener a specific distance from horizontal track front lip 38.

The operation of the mechanized roof laying system is as follows: The lateral supports are applied to the upper portion of a roof and desirably to the peak of the roof. Care is taken in positioning all attachment plates 23 to the peak in exact alignment with one another. The initial lateral support is applied along one side of the roof. The remaining lateral supports are spaced apart an exact distance which corresponds to the width of the horizontal track sections 30 such as 19'. The last lateral support, depending upon the width of the roof, is generally placed at a position to accommodate a smaller width horizontal track section. Typically, lateral supports 20 are of a sufficient length so that they extend from the roof peak to the lower edge of the roof and extend thereover. Should an exceedingly long roof be utilized, a plurality of lateral supports 20 can be attached to one another in tandem. To the overhang portion of the lateral supports is applied the horizontal platform tracks. That is, tracks 30 are mounted such that stop brackets 54 thereof engage alignment tabs 28 of the lateral support. A plurality of the horizontal track sections are connected by applying them across the roof to a corresponding alignment tab of an adjacent lateral support until the entire width of the roof has been covered with horizontal tracks. A continuous platform thus spans the roof and provides a continuous longitudinal track and guide rail for carriage 60. The last track is of a size such that it extends to the side edge or end of the roof. Appropriate sized spacer bars 44 are then connected such that platform 42 is pivoted to a level position. Carriage 60 is then applied to the platform with wheels 65 thereof engaging platform rail 52. A load of shingles is then positioned on the carriage. Starting at one end of the roof, the carriage operator positions the first shingle on the roof with its lower edge against front alignment lip 38 of the horizontal track. The carriage operator then moves the carriage along the platform and applies another shingle to the front lip of the horizontal track and abuts the second shingle against the first shingle. In a similar manner, the carriage operator continues across the entire roof laying and positioning the shingles. A fastener operator follows along on the platform and secures each of the shingles to the roof as through the use of a pneumatic stapler gun. Once the far edge of the roof has been reached, both operators merely pick up each horizontal track section and move it to the next alignment tab 28. The next row of shingles is then positioned and fastened. The procedure is then repeated until the entire roof has been shingled. The lateral supports, carriage, and the horizontal track sections can then be removed and the very top row abutting or covering the peak shingled by hand.

The roofing system of the present invention has been found to yield an excellent alignment of the various individual shingles. The shingles moreover are quickly and rapidly laid in position inasmuch as the carriage is easily transported across the various horizontal track sections. Due to the close proximity of the shingles to the actual roof surface to be shingled, very little strain or physical exertion is placed upon the carriage operator. The entire procedure is exceedingly rapid and achieves a high production rate with very few operators. The system is also very cost efficient.

Although the above invention has been described with regard to applying shingles to a roof, it is to be understood that it can also be utilized whenever a plurality of various individual covering or coating members is applied to a roof or other substrate.

While in accordance with the present invention, a best mode and preferred embodiment have been set forth in detail, the scope of the invention is not limited thereto, but rather by the scope of the attached claims.

What is claimed is:

1. A mechanized system for applying shingles to a roof, comprising:

at least a pair of lateral supports attachable to the roof, said lateral supports having a plurality of alignment tabs extending therefrom, at least one horizontal track section, said horizontal track section engaging said alignment tabs, said track section having a front alignment lip guide, said horizontal track sections having a platform, a frame, and spacer bars, said spacer bars connecting said platform to said frame and positioning said platform in a substantially level position, and a shingle carriage, said shingle carriage slidably engaging said track section so that shingles can be laid in alignment on the roof against said alignment lip guide.

2. A mechanized system for applying shingles to a roof according to claim 1, wherein said horizontal track section has a guide rail, said carriage slidably engaging said guide rail.

3. A mechanized system for applying shingles to a roof according to claim 2, wherein said lateral supports substantially extends along the length of said roof and wherein said at least one horizontal track section engages said lateral supports and substantially extend along the width of said roof in a continuous manner, and wherein said carriage travels on said at least one horizontal track section so that a continuous row of the shingles can be laid in alignment.

4. A mechanized system for applying shingles to a roof according to claim 3, wherein said horizontal track sections are movable to an adjacent alignment tab so that another row of shingles can be laid in alignment on the roof.

5. A mechanized system for applying shingles to a roof according to claim 4, including horizontal track section stop brackets, said stop brackets attached to said track section frame, said stop brackets engaging said alignment tabs.

6. A shingle alignment apparatus, comprising:

a horizontal track section, said track section having a platform and an alignment lip, said platform being hingedly connected to said horizontal track section and being pivotally movable to a substantially level position, said horizontal track section having a frame and spacer bars, said spacer bars connecting said hinged platform to said frame, a pair of lateral supports supportable by a roof, said horizontal track section engaging said lateral supports.

7. A shingle alignment apparatus according to claim 6, wherein said horizontal track section has a rail, including a carriage, said carriage horizontally and slidably engaging said rail.

8. A shingle alignment apparatus according to claim 7, wherein said lateral supports contain a plurality of alignment tabs, said horizontal track section engaging said alignment tabs.

9. A shingle alignment apparatus according to claim 8, including a plurality of said horizontal track sections and a plurality of lateral supports, said horizontal track sections connected to said lateral supports and forming a continuous platform for said carriage.

10. A shingle alignment apparatus according to claim 6, including a plurality of said horizontal track sections and a plurality of lateral supports, including a carriage, said horizontal track sections connected to said lateral supports and forming a continuous platform for said carriage.

* * * * *